United States Patent [19]

Jacobs

[11] 4,248,365

[45] Feb. 3, 1981

[54] PORTABLE SKI EQUIPMENT CARRIER

[76] Inventor: Kenneth P. Jacobs, 2332 W. Cortez, Phoenix, Ariz. 85029

[21] Appl. No.: 957,994

[22] Filed: Nov. 6, 1978

[51] Int. Cl.[3] ..... A45F 3/00; B65D 69/00

[52] U.S. Cl. ..... 224/45 S; 224/50; 280/814

[58] Field of Search ..... 224/45 S, 45 R; 280/11.37 K, 11.37 A, 809, 814; 211/60 SK; 228/50, 51, 45 P

[56] References Cited

U.S. PATENT DOCUMENTS

| | | | |
|---|---|---|---|
| 3,210,787 | 10/1965 | Allsop | 224/45 S |
| 3,272,413 | 9/1966 | Pfleider | 224/45 S |
| 3,568,902 | 3/1971 | Highberger | 224/45 S |
| 3,905,610 | 9/1975 | Dini | 224/45 S |
| 3,990,655 | 11/1976 | Covell | 224/45 S |
| 4,043,493 | 8/1977 | Camelio | 280/11.37 A X |

*Primary Examiner*—Robert J. Spar
*Assistant Examiner*—Jerold M. Forsberg
*Attorney, Agent, or Firm*—Cahill, Sutton & Thomas

[57] ABSTRACT

A portable ski equipment carrier includes a ski holder section having a bottom and first and second vertical sides. A pair of skis are positioned edgewise on a rectangular foam pad attached to the bottom of the ski carrier section. A boot tree having a slotted upright column rigidly attached to a base has a pair of movable boot engaging elements and a pair of fixed boot engaging elements for engaging the respective heel and toe of a pair of ski boots. The rigid base of the boot tree is hingably attached to the first vertical side of the ski carrier section. The lower surface of the base of the boot tree and the upper surface of the bottom of the ski holder section have resilient layers attached thereto, which resilient layers press against the respective upper and lower edges of the skis. A locking device connects an unhinged edge of the base of the boot tree to the second vertical side of the ski carrier section. A handle is provided on top of the slotted upright column so that the portable ski equipment carrier can be easily carried in one hand by the user. Ski clips are attached to the boot tree base plate to hold ski poles parallel to the skis. Additional clips for carrying ski gloves and the like are attached to the opposed edges of the slotted column.

6 Claims, 11 Drawing Figures

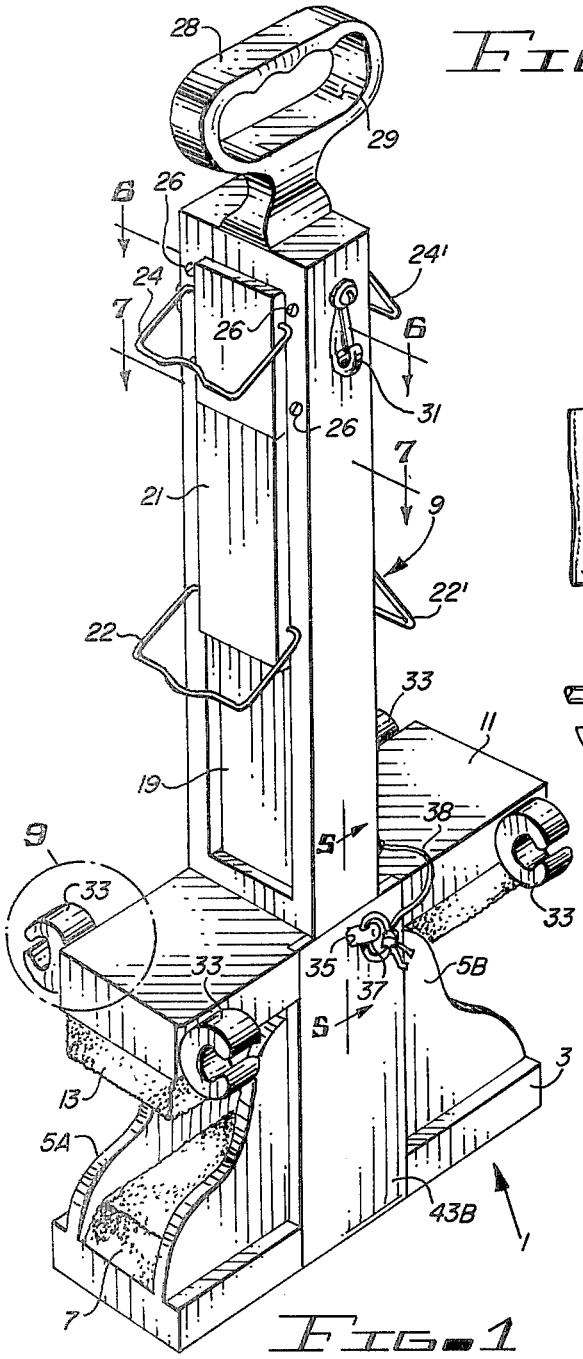
FIG. 1
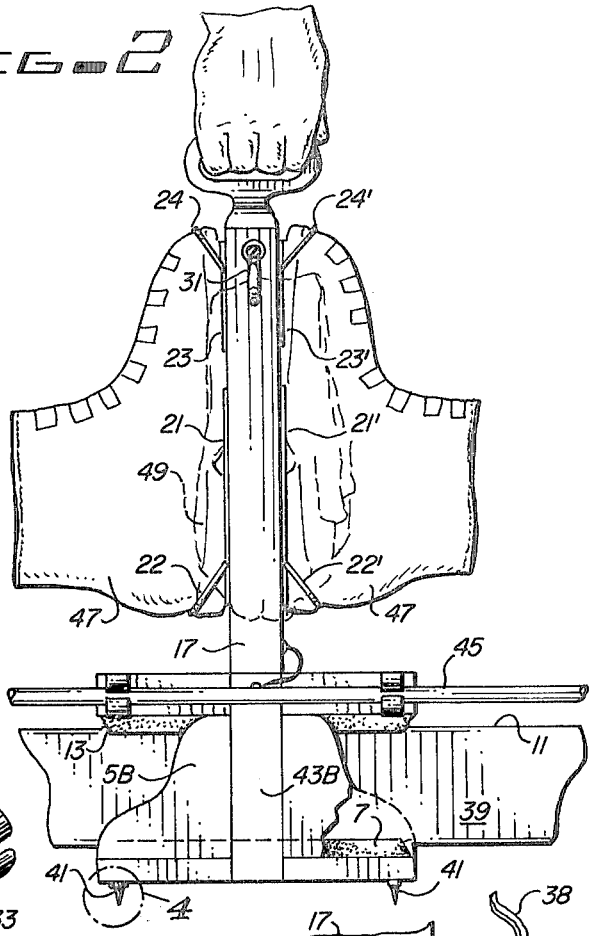
FIG. 2
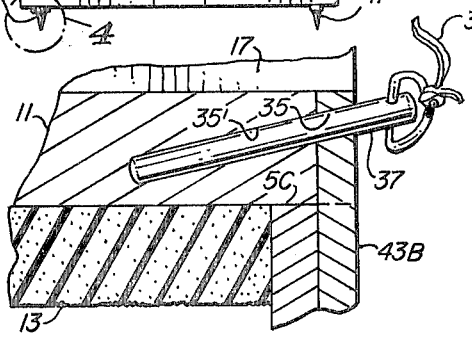
FIG. 5
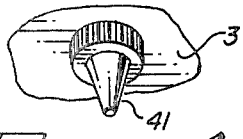
FIG. 4
FIG. 3
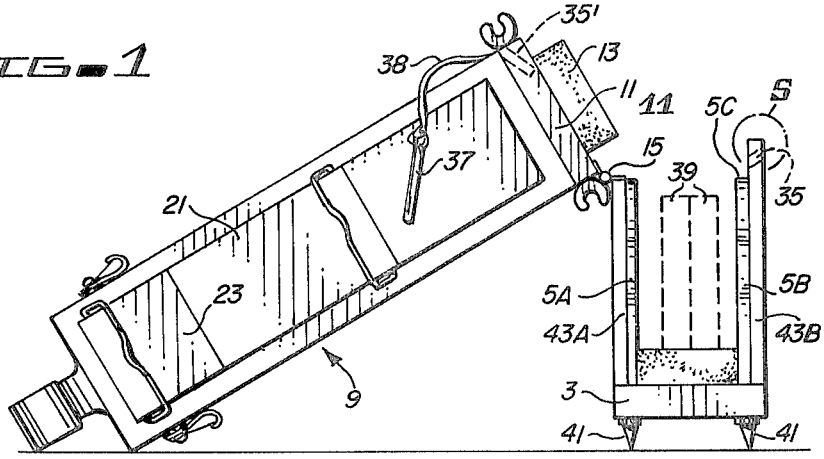

PORTABLE SKI EQUIPMENT CARRIER

BACKGROUND OF THE INVENTION

1. Field of the Invention

The invention relates to portable apparatus for carrying ski equipment, and more particularly, to portable apparatus for carrying both ski boots and skis.

2. Description of the Prior Art

Ski equipment is inherently unwieldy and inconvenient to transport and store, since skis are long and heavy and difficult to handle. Ski poles are also long and difficult to handle; ski boots are quite heavy and bulky, and ski gloves and goggles are easily misplaced and lost. Due to the completely different sizes, weights and configurations of the above items, it is very difficult for a skier to carry such items along with other items useful to skiers (such as baggage containing skiing apparel and personal items) from an automobile to a ski lodge. It is also difficult for skiers to carry the above items to a ski slope which may be distant from a ski lodge or an automobile parking area.

Modern ski lodges are frequently large, luxurious establishments having ski lockers, restaurant facilities, cocktail lounges and the like, as well as lodging facilities. Such modern ski lodges are frequently very crowded during the skiing season. An important aspect of the activities at modern ski lodges frequently includes afternoon and evening socializing after a skier spends the earlier part of a day on the ski slopes. A skier may return directly from the ski slopes wearing his skiing apparel and carrying his skiing equipment. He or she may desire to go directly to a cocktail lounge or restaurant or the like without changing clothes or unloading his or her ski equipment in a ski locker or in the trunk of a distant automobile. The problems of transporting and/or temporarily storing bulky, unwieldy ski equipment in the course of the above described activities is a frequent source of inconvenience and irritation to skiers.

In order to help a skier overcome the above problems, a variety of ski equipment carrying devices have been devised. Various bags and straps have been devised for carrying ski boots and items of ski apparel, such as those disclosed in U.S. Pat. Nos. 3,587,951, 3,749,323 and U.S. Pat. No. Des. 199,296. However, the devices disclosed therein only solve part of the problem, since they are unsuitable for carrying skis and ski poles. Ski boot trees for carrying ski boots have also been devised. U.S. Pat. No. 3,297,219 discloses such a device; U.S. Pat. No. 3,909,718 shows a similar device adapted for carrying ice skates. Such devices are unsuitable for carrying skis and ski poles, and therefore do not solve the problem of inconvenience caused by bulky, unwieldy ski equipment. Various portable holders and carriers have been devised for carrying skis and associated bindings and ski poles, such as those disclosed in U.S. Pat. Nos. 3,877,623, 3,921,871 and 4,002,277. However, none of the devices disclosed therein include means for carrying ski boots. U.S. Pat. No. 3,718,242 discloses a ski equipment carrier adapted to carry a pair of skis, a pair of ski poles, and a pair of ski boots. The disclosed device therein includes a boot tree section removably suspended by means of a hook attached to the bottom of a ski carrier section. The ski carrier section includes a pair of panels suspended from a handle. A pair of rubber straps are attached to one edge of the respective panels and are also attached (at their opposite ends) to latch elements disposed at opposite edges of the respective panels. The rubber straps are stretched around the ski poles and skis, each rubber strap binding a ski pole and a ski against a respective one of the suspended panels. Each latch element is hooked to the corresponding latch element attached to the upper end of one of the suspended panels. The device described in U.S. Pat. No. 3,718,242 suffers from the shortcoming that it is quite unwieldy to use. If it is temporarily placed on a floor (for example in a lobby or a cocktail lounge at a ski lodge) the ski carrier section will flop sideways and probably become unhooked from and separated from the boot tree. Thus, it can be seen that the device is not truly a single, integral unit. If the ski holder section does not become unhooked, its flopping will cause the boot tree to fall on its side. Deploying of the disclosed latch elements and rubber straps to separately attached each ski pole and ski against one of the suspended panels is an unwieldy and inconvenient task, especially if performed on a ski slope under cold weather conditions. The user would probably have to remove his ski gloves and subject his hands to the cold and wind to deploy the ski equipment carrier of U.S. Pat. No. 3,718,242. The device also has the shortcoming that a ski pole and a ski bound by a single strap are likely to become skewed if the end of the ski pole brushes against an object which deflects it from its weakly maintained position parallel to the lower edge of the adjacent ski. The ski equipment carrier therefore is not suitable for carrying a combination of long skis and short poles, since the baskets of the ski poles must be placed beyond an end of the ski with which the ski pole is bound. In short, the device shown in U.S. Pat. No. 3,718,242 is itself an unwieldy combination of two separate units which are merely hooked together. It does not meet the needs of a modern skier. There is clearly an unmet need for a rigid, self-contained device capable of carrying a pair of skis and ski poles and a pair of ski boots. The device should be easily deployable to load and unload the skis, ski poles and ski boots and should be useful for temporarily storing the equipment therein in an orderly fashion.

Accordingly, it is an object of the invention to provide a rigid, self-contained carrier for skis, ski poles, and ski boots, which carrier can be conveniently carried in one hand by a skier.

Another object of the invention is to provide a carrier for skis, ski poles and ski boots, which carrier can be placed on a flat surface so as to occupy minimum space with minimum danger of being tipped over and minimum danger of separation of skis and ski boots.

Yet another object of the invention is to provide a carrier for skis, ski poles and ski boots wherein the skis, ski poles, and ski boots can be easily loaded and unloaded by a skier with gloved hands.

SUMMARY OF THE INVENTION

Briefly described, and in accordance with one embodiment thereof, the invention provides a portable ski equipment holder including an upper boot tree hingably connected to a lower ski holder section having a base and two opposed vertical sides. The boot tree includes a vertical column rigidly attached to a base which is hingably connected to one of the vertical sides of the ski holding section. The base is engaged by means of a locking device to the other vertical side of the ski holding section. The base of the boot tree serves as a hinged top of the ski holding section, whereby the boot tree is pivoted to raise the base to allow loading or unloading of skis between the vertical sides and is provided to clamp the skis between the base of the boot tree and the bottom of the ski holding section. First and second layers of resilient material are disposed on the upper surface of the bottom of the ski holding section and on the lower surface of the base of the boot tree section in order to facilitate semi-rigid clamping of skis of varying widths between the bottom of the ski holding section and the base of the boot tree. A plurality of clips for holding ski poles parallel to skis clamped in the ski holding section are attached to the base of the boot tree. A handle is connected to the top of the vertical column of the boot tree to enable a skier to conveniently carry the portable ski equipment carrier loaded with skis, ski poles, ski boots, and ski gloves in one hand.

In the described embodiment of the invention, the locking device includes a rigid pin insertable through a first hole which extends through an upper portion of the unhinged vertical side of the ski holder section. A second hole in the base of the boot tree is aligned with the first hole when the base of the boot tree is in a lowered position. The base of the boot tree is locked to the ski holding section by inserting the pin snugly into the two aligned holes, thereby rigidly engaging the boot tree to the side of the ski holding section. Cleats are provided on the under surface of the bottom plate of the ski holding section to prevent the portable ski equipment carrier from sliding on sloped surfaces such as hard crusted snow.

BRIEF DESCRIPTION OF THE DRAWINGS

FIG. 1 is a perspective view of the portable ski equipment carrier of the present invention.

FIG. 2 is a partial side view illustrating the portable ski equipment carrier of FIG. 1 with the skis, ski poles, ski boots, and ski gloves appropriately disposed therein.

FIG. 3 is an end view of the portable ski equipment carrier of FIG. 1 illustrating pivoting of the boot tree about a hinge attached to the ski holding section to facilitate loading or unloading of a pair of skis.

FIG. 4 discloses a bottom cleat of the ski equipment carrier of the invention.

FIG. 5 is an expanded view of the locking mechanism of the ski equipment carrier of FIG. 1.

DESCRIPTION OF THE INVENTION

Figure 6:
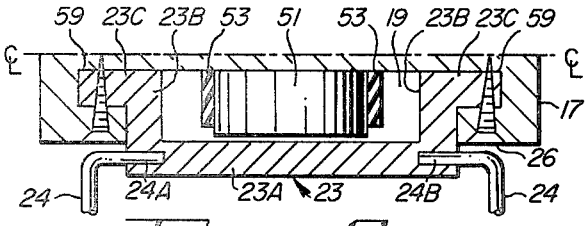
FIG. 6 is a partial sectional view taken along section lines 6—6 of FIG. 1.

Referring now to the drawings, and particularly to FIG. 1, ski equipment carrier 1 includes a ski holder section 2 hingably connected to a boot tree 9. A handle 28 is connected to the upper end of boot tree 9 to permit ski equipment carrier 1 loaded with skis 39, ski poles 45, ski boots 47 and ski gloves 49 to be easily carried with one hand by a skier, as shown in FIG. 2.

Referring again to FIG. 1, ski holder section section 2 includes a bottom plate 3 having two opposed sculptured vertical sides 5A and 5B extending vertically from bottom plate 3. Sides 5A and 5B include reinforcing side braces 43A and 43B, as shown in both FIGS. 1 and 3. Reinforcing side brace 43B extends above the sculptured portion of vertical side 5B in order to allow the upper edge 5C of the sculptured portion of vertical side 5B to serve as a rest or stop for the under surface of base plate 11 of boot tree 9.

The reason for providing a stop for base plate 11 is more clearly understood by referring to FIG. 3, wherein it can be seen that base plate 11 is hingably attached by means of hinge 15 to vertical brace 43A of vertical side 5A.

Boot tree 9 includes a slotted upright column 17 having recesses 19 (see FIGS. 6 and 7) symmetrically disposed in opposite major surfaces thereof. Upright column 17 is rigidly attached at its lower end to the upper surface of base plate 11. Handle 28 is rigidly attached to the upper end of upright column 17.

It can be seen that base plate 11 functions as a hingable top for ski holder section 2 and also serves as a base for boot tree 9. Boot tree 9 can be pivoted sideways about hinge 15, as shown in FIG. 3, to permit loading of skis 39 into the region bounded by vertical side walls 5A and 5B and by bottom plate 3. Skis 39 are positioned edgewise into ski holder 2, as clearly shown in FIGS. 2 and 3, and are semi-rigidly held in place by means of resilient pads 7 and 13, which are adhesively fastened to the upper surface of bottom plate 3 and the lower surface of base plate 11, respectively. Resilient pads 7 and 13 are sufficiently thick and compressibly resilient that skis of varying widths can be positioned in the ski holder as shown in FIGS. 2 and 3 because when boot tree 9 is pivoted upright so that the lower surface of base plate 11 rests on the upper edge 5C of vertical side wall 5B, the respective edges of the skis are pressed into both of resilient pads 7 and 13.

Figure 11:
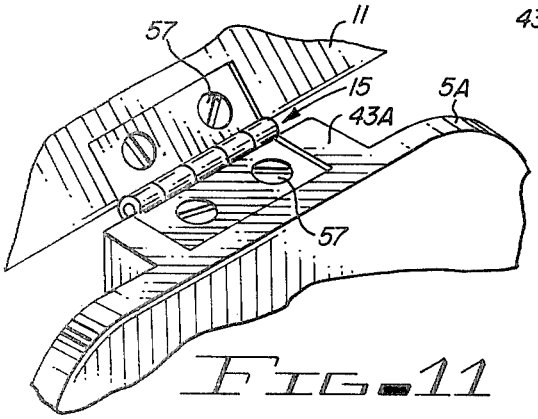
FIG. 11 is an expanded view of the hinge shown in FIG. 3.

At that point, boot tree 9 can be rigidly connected to ski holder section 2 by means of a locking device which connects the right hand side of base plate 11 to vertical brace 43B. Of course, hinge 15 connects the left hand side of base plate 11 to vertical brace 43A (the details of hinge 15 are shown in FIGS. 10 and 11 whereby it is seen that hinge 15 includes two leaves connected, respectively, to the lower surface of base plate 11 and the upper edge of side vertical brace 43A by means of screws 57).

Figure 10:
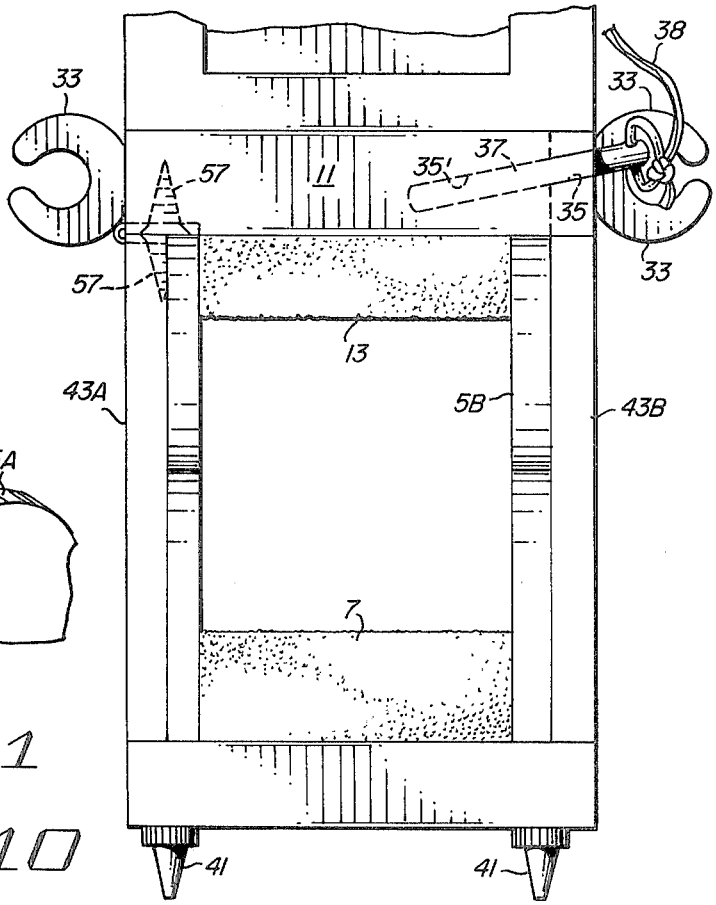
FIG. 10 is an expanded end view of the ski carrier portion of FIG. 1.

The details of the locking device are shown in FIGS. 5 and 10 wherein it is seen that the right hand end of base 11 and the upper portion of vertical side brace 43B have inclined holes 35' and 35 therein. Holes 35' and 35 are aligned when the under surface edge of base plate 11 rests on edge 5C of vertical side 5B, as shown in FIG. 5. A rigid steel peg 37 is then snugly inserted through both of inclined holes 35 and 35', thereby locking base plate 11 to ski holder section 2. A cord or chain 36 is connected to a ring attached to one end of peg 37 and is also connected to a convenient point on on upright column 17 to prevent peg 37 from accidently being lost. Holes 35 and 35' are inclined, as shown in FIG. 5, in order to prevent peg 37 from gradually becoming loosened due to vibrations and the like.

Some additional noteworthy features of ski equipment carrier 1 are now pointed out. Referring to FIGS. 2 and 3, it can be seen that a plurality of cleats 41 are attached to the under surface of bottom plate 3. FIG. 4 shows an enlarged view of one of such cleats. The cleats are useful in preventing ski equipment carrier 1 from sliding if it is placed on an inclined surface, such as an inclined surface of crusted snow.

Figure 9:
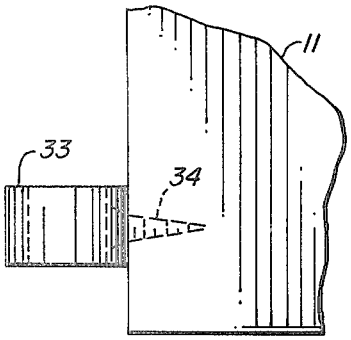
FIG. 9 is an expanded view of the ski pole clips of the ski equipment carrier of FIG. 1.

Ski clips 33 are attached to the four corners of base plate 11 by means of screws 34, as shown in FIG. 9, which discloses an enlarged top view of one of the ski clips. The ski clips are preferably formed of a flexible hard, rubber-like material or a flexible plastic material in order to semi-rigidly hold ski poles 45 as illustrated in FIG. 2.

Clips 31, as shown in FIGS. 1 and 2, can be utilized to hold a pair of ski gloves 39 or other accessories such as goggles or the like.

The details of boot tree 9 are best seen by reference to FIGS. 1 and 6-8. It should be noted that the clamping elements on each major face of upright column 17 are identical, so only one set of clamping elements will be described herein.

Figure 7:
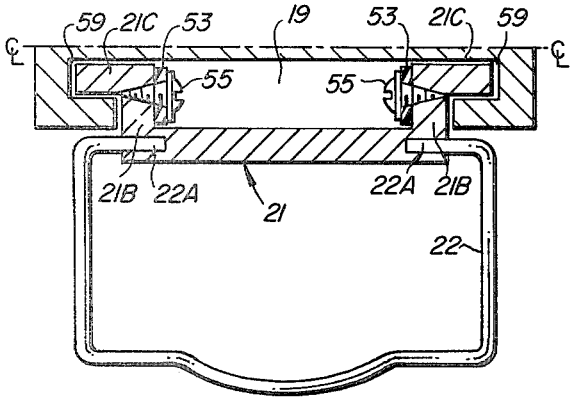
FIG. 7 is a partial sectional view taken along section lines 7—7 of FIG. 1.
Figure 8:
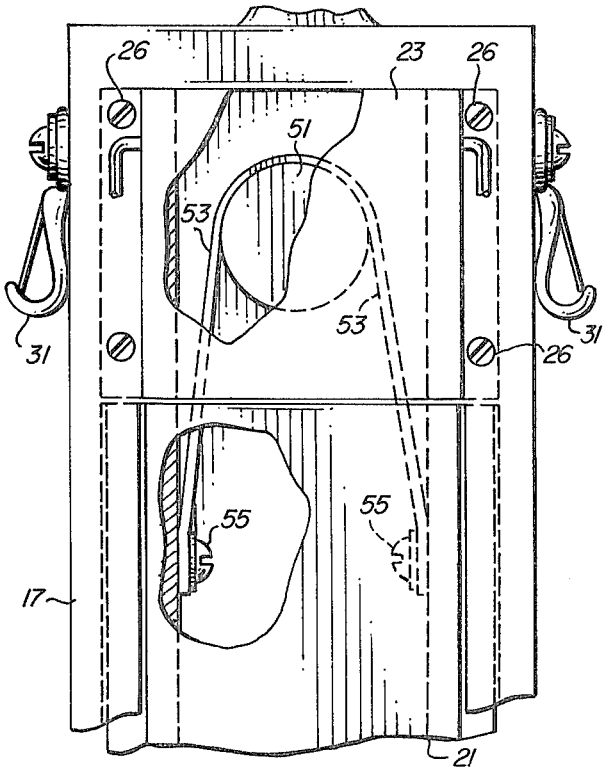
FIG. 8 is a partial cutaway view illustrating details of the sliding blocks and upright column of the device shown in FIG. 1.

Referring to FIG. 1, a pair of boot engaging loops 22 and 24 are connected, respectively, to sliding block 21 and rigid block 23. A sectional view of sliding block 21 taken along section 7—7 is shown in FIG. 7. First, it should be noted that pair of vertical grooves 59 extend laterally into upright column 17 along the bottoms of the side walls of recess 19. Sliding block 21 has a U-shaped configuration having legs 21B connected by section 21A. Each of legs 21B has an outward flange 21C which serves as a tab extending loosely into the adjacent slot 59. Thus, sliding block 21 can slide vertically within recess 19. Boot engaging loop 22 is hingably connected to sliding block 21 by means of holes 22A and sliding block 21 as clearly shown in FIG. 7. Loop 22 (and loop 23) can be made of spring steel or the like.

Boot engaging loop 24 is hingably connected to fixed block 23 in the same manner as boot engaging loop 22, described above. The details of fixed block 23 can be best seen by reference to FIG. 6, which is a sectional view taken along section lines 6—6 of FIG. 1. It can be seen that fixed block 23 has the same general configuration as sliding block 21, wherein section 23A connects legs 23B, each of which has a flange or tab 23C extending into slot 59. However, flanges 23C fit tightly into slot 59, rather than loosely, and are rigidly maintained therein by means of screws 26.

A strong rubber band 53 is connected between sliding block 21 and fixed block 23 to maintain a predetermined force on sliding block 21, urging sliding block 21 against fixed block 23. Thus, when sliding block 21 is lowered and boot engaging loops 22 and 24 are positioned to engage the heel and toe, respectively, of boot 47, rubber band 53 produces a necessary upward force on sliding block 21 to securely maintain ski boot 47 in the position shown in FIG. 2. Rubber band 53 is looped over a drum 51 (which is attached to the bottom of recess 19) and connected to the inner surfaces of legs 21B of sliding block 21 by means of screws 55, as shown clearly in FIGS. 7 and 8.

In the original embodiment of the invention, bottom plate 3, vertical sides 5A and 5B, and vertical side braces 43A and 43B were all made of hardwood. Upright column 17, base plate 11, sliding blocks 21, 24, and handle 28 were also all made of hardwood. Ski clips 23 were formed of flexible plastic, accessory clips 31 were commercially available clips, and resilient pads 7 and 13 were formed of foam rubber. Plates 41 were formed of steel, although a hard, but nonscratching type of plastic material might be preferable to avoid scratching of floors or the like.

It should be apparent that variations in the described structure may be made within the spirit and scope of the present invention. For example, various plastic materials other than wood might be utilized to form the various elements of ski holder section 2 and boot tree 9. Fixed block 23 could be an integrally formed part of upright column 17. Alternative slot arrangements for sliding block 21 might be utilized. Also, different spring or stretchable band arrangements might be utilized to urge sliding block 21 or boot engaging loop 22 upward to maintain a predetermined force clamping the ski boots to boot tree 9. And, of course, different hinging and locking arrangements could be utilized to connect base plate 11 to ski holder section 2.

I claim:

1. Apparatus for carrying skis, ski poles, and ski boots, said apparatus comprising in combination:

a. a handle;

b. a boot tree including:

i. an upright column having an upper end and a lower end;

ii. a base plate having an upper surface and a lower surface, the upper surface of said base plate being rigidly attached to the lower end of said upright column, said upright column being perpendicular to said base plate;

iii. means for fastening a pair of ski boots to said upright column;

c. a ski holder including i. a bottom plate for supporting skis, said bottom plate having a lower surface and an upper surface;

ii. a first vertical side attached to one edge portion of said bottom plate and a second vertical side attached to an opposed edge portion of said bottom plate;

d. hinge means for pivotally connecting a first edge portion of said base plate to an upper edge of said first vertical side, said base plate forming a pivotally connected top plate for said ski holder, whereby said base plate can be pivoted to raise said base plate in order to allow skis to be placed in said ski holder and to lower said base plate to clamp the skis in said ski holder;

e. fastening means for rigidly fastening a second portion of said base plate to an upper edge of said second vertical side to secure said base plate in fixed rigid parallel relationship to said bottom plate when said fastening means is engaged, said second edge portion being an opposite edge portion of said base plate, said upright column always being perpendicular to said bottom plate when said fastening means is engaged;

f. first and second ski pole holding clips attached to opposed ends of a first side surface of said base plate and third and fourth ski pole holding clips attached to opposite ends of a second side surface of said base plate for supporting first and second parallel ski poles, said fastening means being positioned to avoid extending of any portion of said fastening means between either said first and second ski pole holding clips or said third and fourth ski pole clips, thereby avoiding interfering with any ski pole held by any of said ski pole clips; and g. a first resilient pad attached to the upper surface of said bottom plate and a second resilient pad attached to the lower surface of said base plate, said first and second resilient pads being sufficiently thick to engage the respective edges of skis placed in said ski holder so as to securely but non-rigidly clamp the skis into said ski holder between said base plate and said bottom plate.

2. The apparatus of claim 1 wherein said second vertical side includes a ridge section upon which said second edge portion of said base plate rests when said base plate is lowered and a lip portion extending upward along a vertical edge of said base plate, said ridge section and said lip section having first and second holes, respectively, said first and second holes being aligned when said base plate is lowered, said lock means including a rigid peg which can be inserted into said first and second holes when said base plate is lowered to secure said base plate to said second vertical side, thereby rigidly locking said boot tree to said ski holder.

3. The apparatus of claim 2 further including flexible cord means for connecting said rigid peg to said boot tree to prevent inadvertent loss of said rigid peg when said rigid peg is not inserted in said first and second holes.

4. The apparatus of claim 2 wherein said column, said handle, said base plate, said bottom plate, and said first and second vertical sides are composed primarily of wood.

5. The apparatus of claim 1 further including a plurality of cleats attached to the lower surface of said bottom plate to prevent said apparatus from sliding on an inclined surface.

6. The apparatus of claim 1 wherein said upright column includes a rectangular recess disposed in a major surface of said upright column, said rectangular recess having a pair of opposed vertical slots extending laterally into said upright column, a first boot engaging element rigidly attached to said upright column for engaging one end of a ski boot, a second boot engaging element for engaging an opposite end of a ski boot, said second boot engaging element being slidably disposed in said rectangular recess and having tabs slidably disposed in said respective vertical slots, and resilient means for elastically urging said second boot engaging means against said opposite end of said boot to maintain a predetermined force thereon, whereby said second boot engaging means can be slid away from said boot, thereby enabling a skier to conveniently fasten or unfasten a ski boot to said boot tree.

* * * * *